US007591743B2

(12) United States Patent
Kennedy, III

(10) Patent No.: US 7,591,743 B2
(45) Date of Patent: Sep. 22, 2009

(54) GOLF BALL

(75) Inventor: Thomas J. Kennedy, III, Wilbraham, MA (US)

(73) Assignee: Callaway Golf Company, Carlsbad, CA (US)

( * ) Notice: Subject to any disclaimer, the term of this patent is extended or adjusted under 35 U.S.C. 154(b) by 48 days.

(21) Appl. No.: 11/846,402

(22) Filed: Aug. 28, 2007

(65) Prior Publication Data

US 2008/0058122 A1 Mar. 6, 2008

Related U.S. Application Data

(60) Provisional application No. 60/824,118, filed on Aug. 31, 2006.

(51) Int. Cl.
*A63B 37/06* (2006.01)

(52) U.S. Cl. ..... 473/378

(58) Field of Classification Search ..... 473/351, 473/378

See application file for complete search history.

(56) References Cited

U.S. PATENT DOCUMENTS 7,018,307 B2 * 3/2006 Ohira ..... 473/378
2003/0106442 A1 * 6/2003 Gosetti ..... 101/35

* cited by examiner

*Primary Examiner*—Raeann Trimiew
(74) *Attorney, Agent, or Firm*—Michael A. Catania; Elaine H. Lo

(57) ABSTRACT

A golf ball having an indicia composed of a novel metallic ink is disclosed herein. The first indicia is preferably composed of a vacuum metallized pigmented ink having a particle size ranging from 10 microns to 12 microns. The ink is preferably an aluminum based ink. The golf ball is preferably a two-piece solid golf ball or a three-piece solid golf ball. The novel ink preferably has a viscosity above about 300 centipoise.

9 Claims, 2 Drawing Sheets

GOLF BALL

CROSS REFERENCES TO RELATED APPLICATIONS

The Present application claims priority to U.S. Provisional Patent Application No. 60/824,118, filed Aug. 31, 2006.

STATEMENT REGARDING FEDERALLY SPONSORED RESEARCH OR DEVELOPMENT

Not Applicable

BACKGROUND OF THE INVENTION

1. Field of the Invention

The present invention relates to a golf ball. More specifically, the present invention relates to a golf ball having a metallic ink printing thereon.

2. Description of the Related Art

Large particle size metallic inks have processing issues, and the luster and sheen of the inks is unappealing.

Heretofore, for the purpose of obtaining written marks with metallic luster such as gold and silver, aqueous ink using glittering pigments have been proposed. For example, Japanese Unexamined Patent Publication Hei 7-118592 proposes an aqueous ink using an aluminum powder pigment. Japanese Unexamined Patent Publication Hei 8-151547 proposes an ink using a pearlescent pigment. Japanese Unexamined Patent Publication Hei 11-29734 proposes an aqueous metallic ink prepared by coloring an aluminum powder with an organic pigment fixed.

Aluminum pigments are used widely in coatings as special-effect pigments. The term special-effect pigments is used to denote pigments which have a directed reflection at oriented, metallic or highly light-refractive particles of a predominantly flat configuration (German Standard DIN 5594). They are always of a plate-like or flake-like configuration and have very large particle diameters compared with dye pigments. Their optical properties are determined by reflection and interference. Depending on transparency, absorption, thickness, single-layer or multi-layer structure, the special-effect pigments exhibit a metallic shine, a pearl shine, interference or interference reflection. The main area of use is in cosmetics and the automobile sector, and in addition in coloring plastic materials, paints, leather coatings, the printing industry and the ceramic industry. (For a comprehensive representation of the technical background, see W. Ostertag, Nachr. Chem. Tech. Lab. 1994, 9, 849).

The aluminum pigments which are most frequently used are aluminum flakes or pigments based on flake-like Cu/Zn-alloys and coated mica flakes, wherein aluminum pigments exhibit a typical metal shine whereas coated mica flakes exhibit a typical pearl shine.

In recent years the need for colored special-effect pigments has increased greatly. Therefore for example oxide-covered copper and brass flakes, substrates which are coated with transition metal oxides such as muscovite, phlogopite or glass, guanine single-crystals (fish silver), BiOCl-single crystals, flake-form haematite single-crystals, flake-form phthalocyanines, micronized titanium dioxide, polished aluminum shot, iron oxide or crushed thin multi-layer films with a Fabry-Perot-structure were used as special-effect pigments.

In comparison, by coloring aluminum pigments, it is possible to produce colored pigments with improved covering capability, compared with pearl shine pigments, and good coloristic options. In that respect, the coloring action is produced either by fixing color pigments by means of polymers, by coating with oxides of different metals using a very wide range of different processes, by coating with a color pigment-bearing oxide layer or by oxidation.

In accordance with U.S. Pat. No. 4,328,042 and EP-A-0 033 457 aluminum flakes are colored by the deposition of iron oxide from iron pentacarbonyl, using a technically very expensive fluidized bed process. That procedure gives rise to gold-colored aluminum pigments.

In accordance with U.S. Pat. No. 5,037,475 color pigments are fixed on the metal surface by carboxyl group-bearing polymers. The pigments obtained however have only a low level of color intensity.

Aluminum pigments are colored in accordance with WO 91/04293 (PCT/US90/05236) by the fixing of polymer-coated color pigments on the metal surface by means of electrostatic forces.

In accordance with EP-A-0 238 906 metal pigments are covered with a titanium dioxide layer by the controlled hydrolysis of an organic titanate ester compound. Various color shades can be achieved by varying the thickness of the oxide layer. For that purpose it is necessary to observe accurately controlled reaction conditions such as pH-value and the rate of adding material by dropping. In order to achieve color effects, it is also necessary to perform a calcination operation which however can only be carried out with difficulty, because of the low melting point of aluminum.

U.S. Pat. No. 4,978,394 describes the production of titanium dioxide-coated aluminum pigments by chemical vapor deposition (CVD) which is technically highly expensive.

U.S. Pat. No. 4,158,074 discloses the production of colored aluminum pigments by coating with a film of hydrated metal oxide. The film is produced by the treatment of fine aluminum flakes or plate portions in an alkaline solution of an iron, nickel, cobalt, zinc or copper salt at elevated temperature by electrochemical reaction of the metal salts.

U.S. Pat. No. 5,261,955 discloses a sol-gel process for the production of colored metal pigments, wherein the metal flakes are dispersed in a sol of an inorganic salt, dispersed after filtration in a solution of an inorganic compound, for example cobalt nitrate, in an organic solvent and finally a sol-gel layer is formed on the flakes by heating.

In accordance with DE 1 95 01 307.7 (Eckart-Werke) aluminum pigments can be colored in a very wide range of different color shades such as for example blue, red, violet and gold, in accordance with a process which is simple from the point of view of the apparatus used, by the controlled hydrolysis of metal acid esters in the presence of color pigments in an organic solvent.

JP-A-61-130375 discloses a gold-colored aluminum pigment, produced by the treatment of aluminum powder with dichromate, sodium fluoride and surface-active agents in acid solution, drying and treatment with a fatty acid derivative. Color shades other than gold cannot be achieved with that process. In addition the toxicity of the chemicals used and their high price represent a major disadvantage of the process.

U.S. Pat. No. 3,067,052 describes colored aluminum pigments which are produced by the oxidation of aluminum powder with $KMnO_4$-solution, possibly with the addition of a reducing agent. The color shade of these pigments is golden, possibly also with a greenish or reddish shade, depending on the respective reducing agent used. In this case also the toxicity of the oxidizing agent has a detrimental effect.

BRIEF SUMMARY OF THE INVENTION

The present invention is directed to a vacuum-metallized pigmented ink printed on a golf ball as an indicia. The golf ball may have an additional indicia composed of a non-metallized ink.

One aspect of the present invention is a golf ball including a core and a cover formed over the core. The cover has an aerodynamic surface. A first coating layer covers the aerodynamic surface of the cover. An indicia is printed on the first coating layer. The indicia is composed of a vacuum metallized pigmented ink having a particle size ranging from 10 microns to 12 microns. The vacuum metallized pigmented aluminum based ink comprises a plurality of aluminum flakes all oriented in one direction. A second coating layer is disposed over the indicia and the first coating layer.

Another aspect of the present invention is a golf ball including a core, a cover, a first coating layer, a second coating layer, a first indicia and a second indicia. The cover is formed over the core and has an aerodynamic surface. The first coating layer covers the aerodynamic surface of the cover. The first indicia is printed on the first coating layer. The first indicia is composed of a vacuum metallized pigmented ink having a particle size ranging from 10 microns to 12 microns. The second indicia is printed on the first coating layer in proximity to the first indicia. The second indicia is composed of a non-metallic ink. A second coating layer is disposed over the indicia and the first coating layer.

Yet another aspect of the present invention includes an intermediate layer composed of an ionomer material, an HPF material, a polyurethane material, windings, polybutadiene or a mixture thereof.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
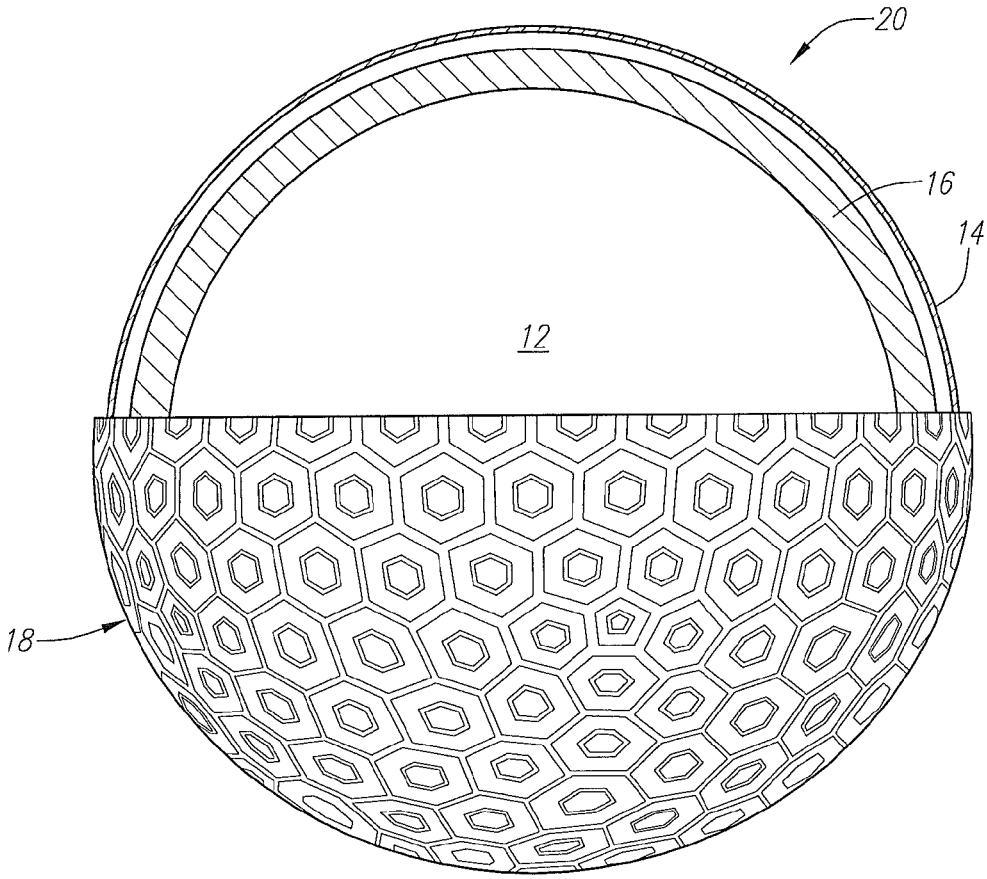
FIG. 1 is a partial cross-sectional view of a golf ball.
Figure 2:
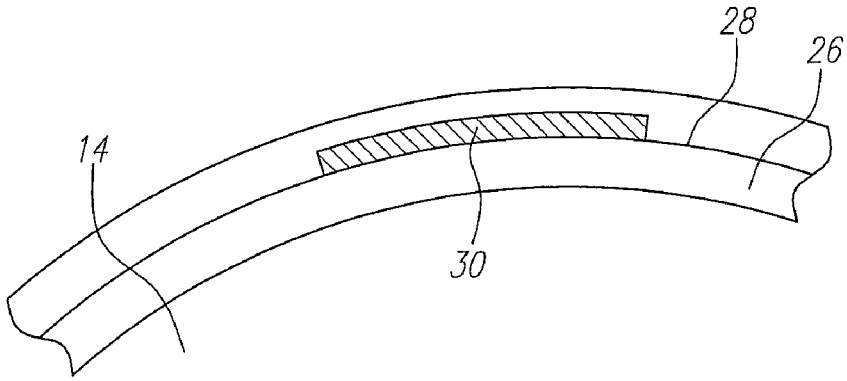
FIG. 2 is a cross-sectional view of the coating layers and indicia for a golf ball of the present invention.
Figure 3:
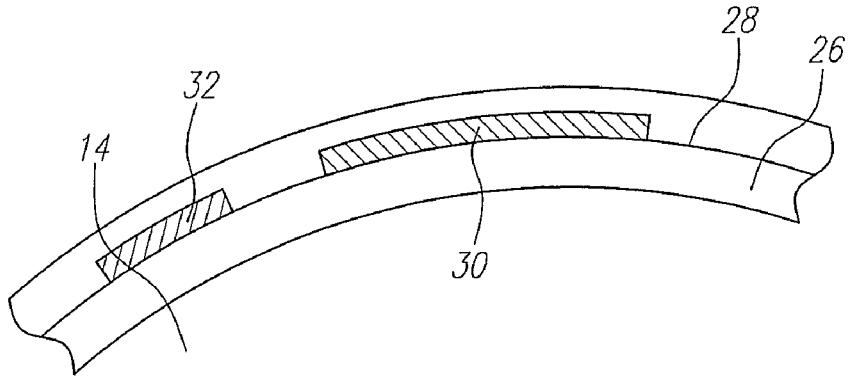
FIG. 3 is a cross-sectional view of the coating layers and indicia for a golf ball of the present invention.

As shown in FIG. 1, a golf ball 20 has a core 12, an intermediate layer 16 and a cover 14. The golf ball 20 may also be a two piece golf ball with only a core 12 and cover 14. The cover 14 has an aerodynamic pattern 18 and is preferably composed of an ionomer material or a polyurethane material. The core 12 is preferably composed of a polybutadiene material As shown in FIG. 2, a first coating layer 26 is placed on the surface of the cover 14. The first coating layer 26 is preferably a paint layer. A first indicia 30 is printed on a surface of the first coating layer 26. A second coating layer 28 is coated over the first coating layer 26 and first indicia 30. The second coating layer 28 is preferably a clear coat layer. An alternative embodiment is illustrated in FIG. 3 wherein a second indicia 32 is printed in proximity to the first indicia 30. The first indicia 30 is composed of a novel metallic ink of the present invention. The second indicia is preferably composed of a non-metallic ink.

The following U.S. patents are owned by Callaway Golf Company, the assignee of the present application, and are hereby incorporated by reference in their entirety: U.S. Pat. No. 5,885,173; U.S. Pat. No. 6,179,730; U.S. Pat. No. 5,459,220; U.S. Pat. No. 5,409,233; U.S. Pat. No. 6,191,185; U.S. Pat. No. 6,638,185; U.S. Pat. No. 5,971,870; U.S. Pat. No. 6,419,594; U.S. Pat. No. 6,958,020; and U.S. Pat. No. 6,855,073.

One embodiment of the ink composition may comprise approximately 5 to 30% by weight of a metallic dispersion component comprising a dispersion solvent and metallic particles, wherein the metallic particles comprise approximately 5% to 15% by weight of the metallic dispersion component; and approximately 70 to 95% by weight of a solvent based ink component comprising an ink solvent, said dispersion solvent and said ink solvent being compatible with each other; wherein the ink composition provides a metallic appearance when evaporatively cured onto a surface of the golf ball.

Generally, in commercial ink printing operations, the lowest operational costs, the greatest operational efficiencies and the highest ink printing speeds, are obtained by operations that utilize an ultraviolet ("UV") curing process to cure or dry ink compositions onto substrates.

For example, in a typical in-line commercial printing operation utilizing UV curing, a particular substrate is printed with a "UV based" ink, and transported or conveyed in-line to a UV curing unit where the ink is cured onto the substrate nearly instantaneously by UV radiation. Conventional UV curing units are typically one foot in length and the substrates travel through the unit at a speed of about one foot per second or greater. Thus, the processing speed of an UV curing unit consuming approximately one foot of in-line processing space is on the order of one unit per second (60 units per minute) or greater. In comparison, in a typical in-line commercial printing operation utilizing an evaporative curing process, the substrate is printed with a solvent based ink and transported or conveyed in-line through a hot air drying oven. The curing time for a solvent based ink depends primarily on the temperature of the drying oven and the evaporation rate of the particular solvent; however, the curing time is generally significantly slower than that required for UV curing. This in turn requires the processing space or length of the drying oven to be longer than the one foot length of a typical UV curing unit. Thus, to achieve processing speeds competitive with those utilizing UV curing, the hot air drying ovens or units for evaporative curing typically consume ten feet or more of in-line processing space. Thus, commercial printing operations utilizing evaporative curing requires substantially more in-line processing space than operations utilizing UV curing, thereby resulting in significantly lower space utilization efficiencies.

Further, commercial printing operations utilizing evaporative curing are subject to increasing governmental regulations regarding the amount, containment and disposal of solvents and solvent emissions used in the printing process. Commercial printing operations utilizing UV curing and "UV based" inks, are typically subject to significantly fewer, if any, government regulations.

Thus, for the above reasons, among possible others, UV curing of ink compositions onto substrates has become the preferred curing process for most commercial printing operations. Indeed, in the commercial screen printing industry, and various other printing industries as well, operations utilizing evaporative curing have become somewhat of a historical relic. Thus, in any new printing application, the primary focus is on UV curing, with little if any attention being given to processes utilizing evaporative curing.

In formulating a metallic ink composition and a method for applying a desired metallic appearance to a plastic substrate, it was first discovered that metallic ink compositions behaved quite differently when applied to plastic substrates as when applied to paper or paperboard substrates. Specifically, it was unexpectedly discovered that, the desired metallic appearance utilizing certain metallic ink compositions could not be readily obtained with printing operations utilizing UV curing, but could be obtained with printing operations utilizing evaporative curing. More specifically, it was discovered that to obtain the desired metallic appearance, (1) a minimum period of time was required during the curing process for the metallic particles within the metallic ink compositions described herein to "cure down" or settle into a generally horizontal position relative to the plastic substrate, and into a substantially parallel position relative to one another, and (2) a solvent based ink, as opposed to a "UV based" ink, was required for the metallic ink composition to properly adhere to the plastic substrate. In other words, it was unexpectedly discovered that if the curing process cures the metallic ink composition onto the plastic substrate too quickly, such as in a UV curing process, the metallic particles "cure up" or settle in a random manner and the desired metallic appearance is not obtained. Thus, one aspect of the present invention is the discovery and recognition that the generally accepted and commonly used UV curing process generally will not work in applying a metallic ink composition onto a plastic substrates in accordance with the present invention, with any hope of achieving the desired metallic appearance. In contrast, it has been discovered that the relatively slower curing processes, such as evaporative curing, will achieve not only a metallic appearance, but an unexpectedly shiny and reflective metallic appearance similar to that obtained by hot foil stamping.

The solvent based ink component of the process and the metallic ink composition may be generally characterized as follows. The resin of the solvent based ink component should be compatible with the plastic substrate and should also provide adhesion for the metallic printing ink to the plastic substrate. Additionally, the solvent of the solvent based ink component should be compatible with the solvent of the metallic dispersion component, which should also be compatible with the plastic substrate. Optionally, the solvent based ink component may be comprised of one or more pigments of various colors that act to provide a colored hue to the metallic appearance ultimately obtained. As used herein, the term "compatible" or "compatible with" is synonymous with solubility or miscibility. In other words, a component which is compatible with a second component means that such component is miscible with or is capable of dissolving in such second component. Components that are compatible may be mixed without reacting chemically or interfering with each components characteristics. Various solvent based ink components will be acceptable for use in the present invention provided they meet the above qualifications. Preferred solvent based ink compositions include the solvent based ink of Coates Screen, Inc. sold under the trademark MONOCAT, the solvent based inks sold by Nazdar Corporation as the 9600 or the 9700 Series, the solvent based inks sold by Coates Screen, Inc. under the trademarks HG 480 Series and FLEXIFORM Series C37 and the solvent based ink sold by Summit Screen Ink under the trademark ZEPHYR-JET. More detailed compositions for some of these inks are set forth in the examples below.

The metallic dispersion component of the process and ink composition may be generally characterized as follows. The metallic dispersion component should be comprised of a solvent compatible with the solvent of the ink and the plastic substrate to which it is to be applied. Further, the dispersion component should be comprised of a percentage by of metallic particles weight of metallic particles sufficient to achieve the desired metallic appearance. Generally, a metallic dispersion component comprised of between about 5% to 15% by weight is preferred, with a metallic dispersion comprised of approximately 10% by weight of metallic particles being most preferred. The metallic particles can be comprised of a variety of metals such as copper, silver and aluminum; however aluminum is the metal preferred.

The metallic particles should preferably have a particle size distribution, defined as the percentage of particles within a range of particle lengths, such that the desired metallic appearance may be ultimately obtained. It has been found that a metallic dispersion component having a particle size distribution of approximately 15% aluminum particles having a length of 3.600 microns to 4.900 microns, approximately 18% aluminum particles having a length of 4.908 microns to 7.950 microns, approximately 15% aluminum particles having a length of 7.957 microns to 10.630 microns, approximately 14% aluminum particles having a length of 10.633 microns to 14.208 microns, approximately 19% aluminum particles having a length of 14.209 microns to 18.980 microns, approximately 13% aluminum particles having a length of 18.986 microns to 27.940 microns, approximately 2% aluminum particles having a length of 27.945 microns to 37.340 microns, and approximately 3% aluminum particles having a length of 37.342 microns to 45.300 microns, is preferred. Similarly, the metallic particles should have an aspect ratio, defined as the ratio of the length of the metallic particles to the width of the metallic particles, such that the desired metallic appearance may be ultimately obtained. It has been found that a metallic dispersion component having an aspect ratio with a minimum of approximately 1.0, a maximum of approximately 5.2 with a mean aspect ration of approximately 1.507 is preferred.

Metallic dispersion components manufactured by various sources will be acceptable provided they have a compatible solvent and a metallic particle concentration and size distribution which results in the desired metallic appearance when printed.

The metallic printing ink is made by mixing the solvent based ink component and the metallic dispersion component and may be generally characterized as follows. The percentage by weight of the metallic dispersion component to the solvent based carrier component should be such that the desired metallic appearance is ultimately obtained. It has been found that a metallic printing ink comprised preferably of approximately 5 to 30% by weight, and more preferably 10 to 25% by weight, of the metallic dispersion component is needed to obtain the desired metallic appearance. Generally, metallic printing inks comprised of more than 30% by weight of the metallic dispersion component results in the appearance of the printed substrate being dark and "muddy" and does not provide the desired metallic appearance. Metallic printing inks comprised of less than approximately 5% by weight of the metallic dispersion component results in the appearance being relatively non-metallic and also does not provide the desired metallic appearance.

It has also been found that if it is desired that the metallic appearance be a purely metallic or silverish appearance, a metallic printing ink comprising approximately 23% by weight of the metallic dispersion component is preferred. If, however, a metallic appearance with a colored hue is desired (e.g., a reddish metallic appearance), a metallic printing ink comprising approximately 12% by weight of the metallic dispersion component is preferred.

The viscosity of the metallic printing ink is dictated primarily by the process by which the ink is printed. For the preferred commercial screen printing process, the viscosity of the metallic printing ink should preferably be above about 300 centipoise, less than about 2000 centipoise and most preferably about 1000 centipoise. While the desired metallic appearance may be achieved with metallic printing inks with viscosities around 300 centipoise, in some cases, bubbling of the metallic printing ink on the plastic substrate tends to occur at these viscosity levels.

For the reasons explained below, the combined solvents of the metallic dispersion component and the solvent based carrier component should have a boiling point such that substantially all of the solvent is evaporated when exposed to oven temperatures from about 150 to 300° F. for about 10 to 15 seconds.

A preferred pigment is SDF-6 series metal pigments available from Eckart America of Painsville, Ohio. Another preferred material is Eckart Aluminum Metalure, L055350. The metalure is mixed with blue UV ink in an amount of 15 parts of the blue UV ink to 3 parts of the metalure.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball comprising:

a core;

a cover formed over the core, the cover having an aerodynamic surface;

a first coating layer covering the aerodynamic surface of the cover, the cover is composed of an ionomer material;

an indicia printed on the first coating layer, the indicia composed of a vacuum metallized pigmented aluminum based ink having a particle size ranging from 10 microns to 12 microns, wherein the vacuum metallized pigmented aluminum based ink comprises a plurality of aluminum flakes all oriented in one direction; and a second coating layer disposed over the indicia and the first coating layer.

2. The golf ball according to claim 1 wherein the second coating layer is a clear coat.

3. The golf ball according to claim 1 wherein the first coating layer is a paint layer.

4. The golf ball according to claim 1 wherein the first indicia has a gold appearance.

5. A golf ball comprising:

a core;

a cover formed over the core, the cover having an aerodynamic surface, wherein the cover is composed of an ionomer material;

a first coating layer covering the aerodynamic surface of the cover;

a first indicia printed on the first coating layer, the first indicia composed of a vacuum metallized pigmented aluminum based ink having a particle size ranging from 10 microns to 12 microns, wherein the vacuum metallized pigmented aluminum based ink comprises a plurality of aluminum flakes all oriented in one direction;

a second indicia printed on the first coating layer in proximity to the first indicia, the second indicia composed of a non-metallic ink; and a second coating layer disposed over the indicia and the first coating layer.

6. The golf ball according to claim 5 wherein the second coating layer is a clear coat.

7. The golf ball according to claim 5 wherein the first coating layer is a paint layer.

8. The golf ball according to claim 5 wherein the first indicia has a gold appearance.

9. The golf ball according to claim 5 further comprising an intermediate layer between the core and the cover, the intermediate layer composed of an ionomer material, an HPF material, a polyurethane material, windings, polybutadiene or a mixture thereof.

* * * * *